US008439997B2

(12) United States Patent
Rupp et al.

(10) Patent No.: US 8,439,997 B2
(45) Date of Patent: May 14, 2013

(54) VACUUM SWEEPER APPARATUS INCLUDING A FILTER BAG AND A METHOD OF INSTALLATION

(75) Inventors: Mark N. Rupp, Delaware, OH (US); Dale A. Krausnick, Perrysburg, OH (US); Hui Hiu Kwan, Yuen Long (HK); Li Jin Long, Guan Dong Sheng (CN); Paul Goetz, Maple Grove, MN (US); Jeffery Scott Kunkler, Shenzhen (CN); Rob Fischner, Gibsonia, PA (US); Aurelio M. Arellano, Jr., Cagayan Valley (PH)

(73) Assignee: NSS Enterprises, Inc., Toledo, OH (US)

( * ) Notice: Subject to any disclaimer, the term of this patent is extended or adjusted under 35 U.S.C. 154(b) by 41 days.

(21) Appl. No.: 13/210,840

(22) Filed: Aug. 16, 2011

(65) Prior Publication Data

US 2013/0042586 A1 Feb. 21, 2013

(51) Int. Cl.
*B01D 46/02* (2006.01)

(52) U.S. Cl.
USPC ..... 55/373; 55/374; 55/378; 55/DIG. 2; 55/DIG. 3; 15/347

(58) Field of Classification Search ..... 55/367, 55/369, 377, 378, 361, 374, 375, DIG. 2, 55/DIG. 3; 15/347, 349, 351, 352, 339, 327.2
See application file for complete search history.

(56) References Cited

U.S. PATENT DOCUMENTS

| | | | |
|---|---|---|---|
| 3,421,298 | A | 1/1969 | Downey |
| 3,432,997 | A | 3/1969 | Downey |
| 3,724,179 | A | 4/1973 | Leinfelt |
| 3,726,067 | A | 4/1973 | Fesco |
| 3,738,091 | A | 6/1973 | Fesco |
| 3,755,992 | A | 9/1973 | Ylinen |
| 3,803,815 | A | 4/1974 | Anderson et al. |
| 3,929,437 | A | 12/1975 | Gaudry |
| 3,933,451 | A | 1/1976 | Johansson |
| 4,539,026 | A | 9/1985 | Kuplas |
| 4,738,697 | A | 4/1988 | Westergren |
| 4,861,357 | A | 8/1989 | Gavin et al. |
| 4,877,432 | A | 10/1989 | Lackner |
| 4,885,013 | A | 12/1989 | Ahlf et al. |
| 5,028,245 | A | 7/1991 | Stein et al. |
| 5,039,324 | A | 8/1991 | Goldberg |
| 5,045,099 | A | 9/1991 | Goldberg |
| 5,064,455 | A | 11/1991 | Lackner |
| 5,089,038 | A | 2/1992 | Kopco et al. |
| 5,092,915 | A | 3/1992 | Lackner |
| 5,158,635 | A | 10/1992 | Schmierer et al. |

(Continued)

FOREIGN PATENT DOCUMENTS

| | | | |
|---|---|---|---|
| DE | 3403121 | A1 | 1/1984 |

*Primary Examiner* — Duane Smith
*Assistant Examiner* — Minh-Chau Pham
(74) *Attorney, Agent, or Firm* — Marshall & Melhorn LLC

(57) ABSTRACT

A filter bag and an apparatus for attaching a filter bag to a vacuum sweeper are provided. The filter bag includes a top plate and a bag portion. The top plate has a key formed thereon. The apparatus includes a sled configured to receive a portion of a filter bag having a key formed thereon. The apparatus also includes a sweeper housing. The sweeper housing is adjacent the sled. The housing has a cavity for receiving a portion of the filter bag and a lock that interconnects with the key. A method for installing the filter bag in a vacuum sweeper is also provided.

23 Claims, 5 Drawing Sheets

U.S. PATENT DOCUMENTS 5,221,303 A 6/1993 Guhne et al.
5,226,941 A 7/1993 Uibel
5,230,724 A 7/1993 Marafante et al.
5,464,460 A 11/1995 Bosses
5,468,271 A 11/1995 Sauer et al.
5,468,272 A 11/1995 Schmierer
5,472,460 A 12/1995 Schmierer
5,472,465 A 12/1995 Schmierer
5,544,385 A 8/1996 Jailor et al.
5,613,989 A 3/1997 Bosses
5,688,298 A 11/1997 Bosses
5,725,620 A 3/1998 Perea et al.
5,755,009 A 5/1998 Stephens
5,772,712 A 6/1998 Perea et al.
5,820,643 A 10/1998 Lienenluke
5,935,280 A * 8/1999 Lee ..... 55/378
6,033,451 A 3/2000 Fish
6,071,322 A 6/2000 Hulthen
6,136,056 A 10/2000 Krehan
6,151,751 A 11/2000 McCormick
6,277,165 B1 8/2001 Lovett
6,379,408 B1 4/2002 Embree et al.
6,451,078 B2 9/2002 Berfield
6,461,394 B1 10/2002 Mattsson
6,626,969 B1 9/2003 Steele
6,716,262 B2 4/2004 Zimet
6,733,555 B1 5/2004 Wilder
6,746,501 B1 6/2004 Wilder
RE38,842 E 10/2005 Fish et al.
7,024,724 B2 * 4/2006 Ponjican et al. ..... 15/347
7,254,865 B2 * 8/2007 Bosses ..... 15/327.2
D559,483 S 1/2008 Matter
7,325,272 B2 * 2/2008 Bosses ..... 15/327.2
7,332,005 B2 2/2008 Wegelin
7,611,555 B2 11/2009 Wattenberg et al.
7,637,975 B2 12/2009 Stein et al.
7,799,107 B2 * 9/2010 Corney et al. ..... 55/367
7,815,704 B2 * 10/2010 Schmierer et al. ..... 55/374
2003/0182907 A1 10/2003 Steele

* cited by examiner

VACUUM SWEEPER APPARATUS INCLUDING A FILTER BAG AND A METHOD OF INSTALLATION

BACKGROUND OF THE INVENTION

This invention relates generally to vacuum sweepers, and more specifically to a vacuum sweeper apparatus including a filter bag and a method of installation.

With the help of a rotating brush, upright vacuum sweepers collect dust and debris materials via the difference between the air pressure inside of the sweeper and atmospheric pressure, i.e. vacuum suction. Vacuum suction causes the dust and debris to become airborne. The air containing the dust and debris is directed to a compartment and filtered to remove the dust and debris.

Typically, a filter bag is positioned within the compartment and utilized for separating the dust and debris from the air. The filter bag not only separates the contaminants from the air but also collects the dust and debris. For convenience and efficiency, when it is full, the filter bag can be disposed of along with the dust and debris. A replacement filter bag can then be used for continued vacuum sweeper operations.

Filter bags should be constructed according to the vacuum sweeper manufacturer's specifications to ensure proper fit and performance. The use of filter bags that do not meet the manufacturer's specifications, especially replacement filter bags, or filter bags made by unauthorized manufactures can be problematic. For instance, filter bags that do not meet the manufacturer's specifications can reduce the performance of the vacuum sweeper and/or its safety characteristics.

Therefore, a need exists for a filter bag, vacuum sweeper apparatus and method of installation which reduces the risk that a substandard filter bag will be utilized during operation of the vacuum sweeper or when replacing a filter bag.

SUMMARY OF THE INVENTION

The present invention is directed to an improved vacuum sweeper filter bag, a vacuum sweeper apparatus including said filter bag, and a method of installation.

In an embodiment, the present invention is a filter bag. The filter bag comprises a bag portion for collecting debris material and a top plate attached to the bag portion. The top plate includes a key formed thereon.

In another embodiment, the present invention is an apparatus for attaching a filter bag to a vacuum sweeper. The apparatus comprises a sled and a sweeper housing. The sled is configured to receive a portion of a filter bag having a key formed thereon. The sweeper housing is adjacent the sled and includes a cavity for receiving a portion of the filter bag and a lock that interconnects with the key.

A method for installing a filter bag in a vacuum sweeper is also provided. The method comprises providing a filter bag having a top plate. A key is formed on the top plate. The method also comprises providing a sled configured to receive the filter bag top plate and providing a lock adjacent the sled. Further, the method comprises positioning the filter bag top plate within the sled and interconnecting the key and the lock so that the filter bag is selectively attached to the vacuum sweeper.

DETAILED DESCRIPTION OF THE PREFERRED EMBODIMENT(S)

Figure 1:
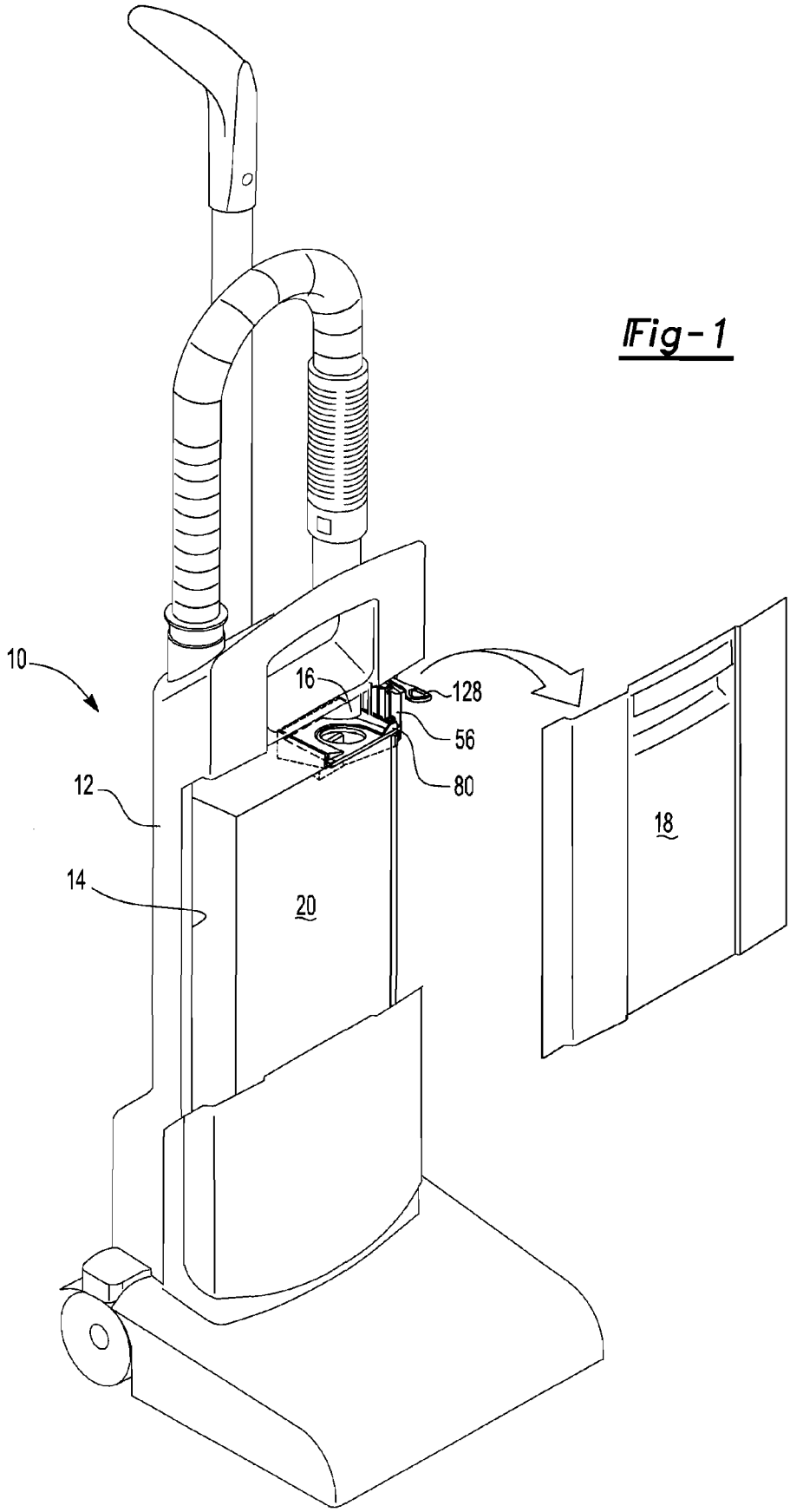
FIG. 1 is a perspective view of a vacuum sweeper capable of being utilized with and practicing the present invention.

It is to be understood that the invention may assume various alternative orientations and step sequences, except where expressly stated to the contrary. It should also be appreciated that the embodiments described and structures illustrated in FIGS. 1-8 and described in the following specification are simply exemplary embodiments of the inventive concepts defined in the appended claims. Also, like elements in various embodiments are commonly referred to with like reference numerals.

The present invention is preferably practiced with an upright vacuum sweeper 10. An example of an upright vacuum sweeper 10 utilized when practicing the present invention is shown in FIG. 1. A preferred brand of upright vacuum sweeper 10 utilized when practicing the present invention is an NSS Pacer brand vacuum sweeper. It should also be appreciated that although the present invention will be described in connection with upright vacuum sweeper 10 the present invention is not so limited and may be used with any upright vacuum sweeper or any sweeper.

Generally, the vacuum sweepers which are suitable for practice with the present invention have a housing 12. The housing 12 protects a fan (not depicted) and a motor (not depicted). The motor drives the fan which then creates a pressure difference which in turn provides suction for the sweeper 10.

The housing 12 may have a cavity 14. As depicted, an air outlet 16 may be located within the cavity 14. It should be noted that for the convenience of illustrating other aspects of the invention that a portion of the air outlet has been removed from FIG. 1. The housing 12 may also include a removable cover panel 18 for gaining access to and enclosing the cavity 14.

In an embodiment, the present invention is directed to a filter bag 20. When installed for operation, the filter bag 20 is preferably located within the vacuum sweeper cavity 14. The filter bag 20 is in fluid communication with the air outlet 16 so that the filter bag 20 can receive dust and debris material contained within the airstream from the vacuum sweeper 10. The filter bag 20 separates the dust and debris material from the air and also collects the dust and debris.

Figure 2:
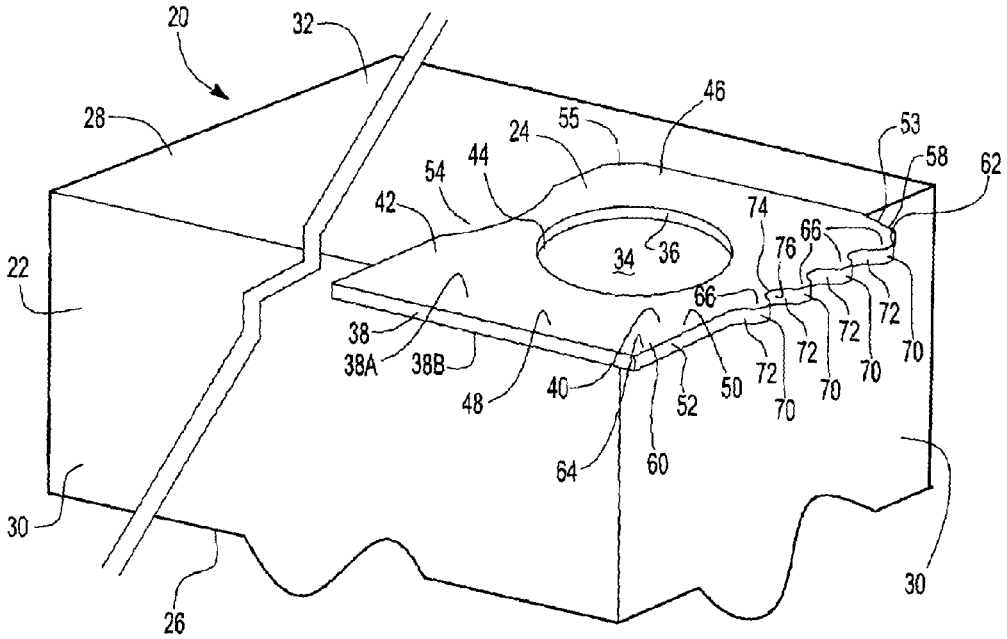
FIG. 2 is a perspective fragmentary view of an embodiment of a filter bag of the present invention.
Figure 3:
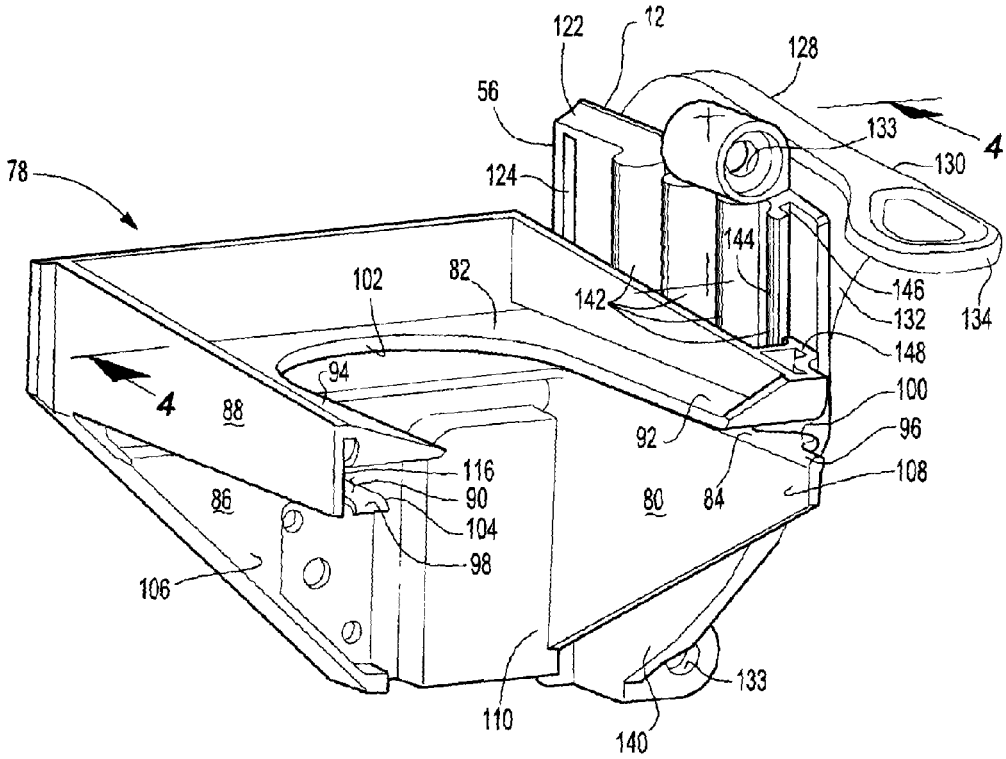
FIG. 3 is partial perspective front view of an embodiment of the apparatus of the present invention.
Figure 4:
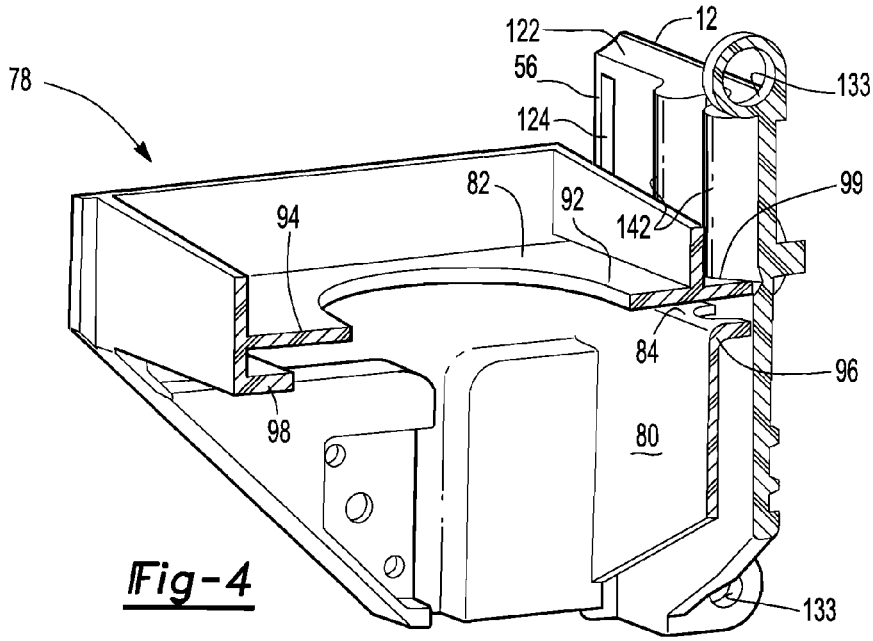
FIG. 4 is a cross-sectional view of the apparatus depicted in FIG. 3 taken along line 4-4.

As best shown in FIG. 2, the filter bag 20 comprises a bag portion 22 and a top plate 24.

The bag portion 22 is utilized for collecting and storing the dust and debris material. The bag portion 22 may be of a generally tubular shape and includes an interior 26 and exterior 28. The bag portion 22 may have sidewalls 30 and a pair of closed ends 32 which define the interior 26 and exterior 28.

One of the closed ends 32 has an opening 34 formed therein for allowing air from the air outlet 16 into the interior 26 of the filter bag 20. When air is moved through or debris is collected within the interior 26 of the filter bag 20, the bag portion 22 may expand.

The bag portion 22 can be made from any suitable filter media material. Suitable materials include porous materials, such as paper, and non-porous materials. The bag portion 22 may also be formed from several layers of material and may include an inner liner.

The top plate 24 is attached to the bag portion 22 so that the opening 34 formed in the closed end 32 is in fluid communication within an opening 36 formed in the top plate 24. The top plate opening 36 and the bag portion opening 34 are preferably concentric but need not be to practice the present invention. When installed in the vacuum sweeper 10, the top plate opening 36 is attached to and surrounds the air outlet 16.

Figure 7:
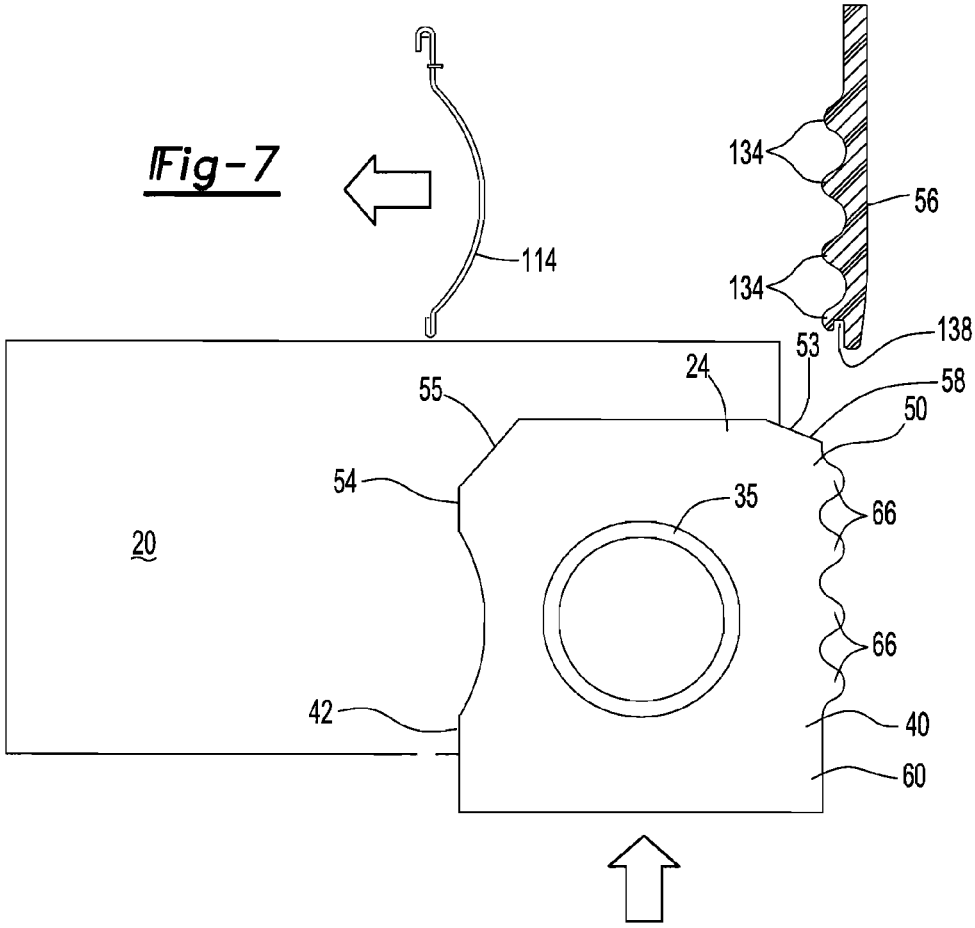
FIG. 7 is a top sectional view of portions of the filter bag and the apparatus of the present invention.
Figure 8:
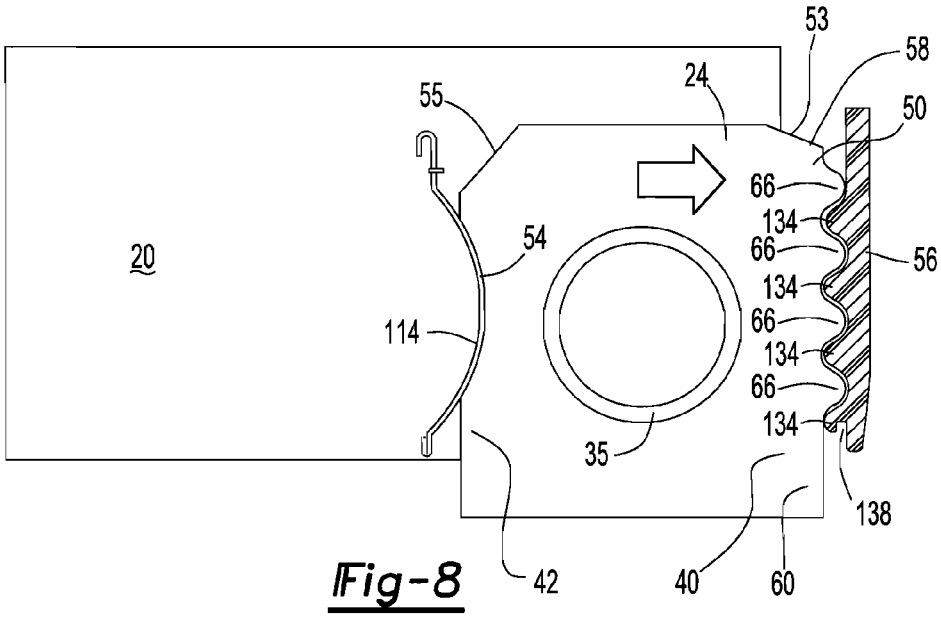
FIG. 8 is top sectional view of portions of the filter bag and the apparatus of the present invention.

Preferably, the bag portion 22 is attached to the top plate 24 with an adhesive. The adhesive may be disposed on the closed end 32 and around the openings 34, 36 in the bag portion 22 and the top plate 24. As shown in FIGS. 7 and 8, a seal ring 35 may be positioned around the openings 34, 36 in the bag portion 22 and the top plate 24. In this embodiment the seal ring 35 has a first surface which is attached to the closed end 32 of the bag portion 22 and a second surface which is attached to a lower surface 38B of the top plate 24. The adhesive may be disposed on and around the seal ring 35 to attach the bag portion 22 to the top plate 24 and provide an effective seal there between.

Referring back to FIG. 2, the top plate 24 has two generally parallel and planar surfaces 38A, 38B with the opening 36 formed therein extending between each surface. The lower surface 38B is positioned between the upper surface 38A and the bag portion 22. Preferably, the top plate opening 36 is formed in a center portion 44 of the top plate 24, but may be offset as well. Each surface has at least two edge portions 40, 42 and the center portion 44. In certain embodiments, the top plate 24 has at least four edge portions 40, 42, 46, 48. The edge portions 40, 42, 46, 48 extend radially outward from the center portion 44 and from the upper surface 38A to the lower surface 38B. It is preferred that the edge portions 40, 42, 46, 48 and center portion 44 are configured to provide a unitary top plate 24.

The top plate 24 includes a key 50 formed thereon. Preferably, the key 50 is formed in the first edge portion 40 of the top plate 24 and more preferably as a part of an edge 52 of the top plate 24. In an embodiment, the second edge portion 42 is located opposite the first edge portion 40. A spring receiving portion 54 is formed in the second edge portion 42. In an embodiment, the spring receiving portion 54 has a concave shape.

In an embodiment, the top plate 24 may have a generally rectangular shape. However, in other embodiments, the third edge portion 46 has a first chamfered edge 53 and a second chamfered edge 55. The chamfered edges 53, 55 combine to reduce the area of the third edge portion 46 and make installing the filter bag 20 in a sled 80 easier.

In an embodiment, the top plate 24 and key 50 are unitary. The key 50 selectively interconnects with a lock 56 located on the vacuum sweeper 10. Since it is contemplated that the key 50 may be interconnected, disconnected, and then reconnected with the lock 56, it is preferable that the top plate 24 is formed of a durable material. Even more preferred is that the top plate 24 is formed from a material which provides a relative amount of rigidity. A cost effective, durable, and relatively rigid material capable of being utilized to form the top plate 24 is cardboard.

In certain embodiments, only a portion of the key 50 interconnects with the lock 56. In these embodiments, the key 50 includes a blade 58 and a non-blade portion 60. The blade 58 is the portion of the key 50 that interconnects with the lock 56. The blade 58 is formed as a unitary manner with to the non-blade portion 60. As shown, in an embodiment, the blade 58 is positioned on an end portion 62 and the non-blade portion 60 is positioned on an opposite end portion 64 of the key 50. In this embodiment, the blade 58 is a contiguous body. However, alternative orientations of the blade and non-blade portions 58, 60 may be utilized in practicing the present invention. For example, the non-blade portion 60 could be positioned between portions of the blade 58.

Preferably, the blade 58 comprises a plurality of teeth 66. Most preferably, the blade 58 has four teeth. However, it should be appreciated that the blade 58 may have many more than four teeth. Additionally, in certain embodiments, it is possible to practice the present invention when the blade 58 has a single tooth.

The teeth 66 extend out beyond the non-blade portion 60. In an embodiment, each tooth 66 is substantially the same size. Furthermore, each tooth 66 may have substantially the same shape. For example, each tooth 66 can have a full or partial square, rectangle, triangle, pie, trapezoid, ellipse, semi-ellipse, semi-circular, or oval shape. Additionally, each tooth 66 can be of a combination of these and/or other shapes. In another embodiment, each tooth 66 may comprise a crest 70 and angled sidewalls 72. However, it should be appreciated that the teeth 66 need not be similarly shaped or sized to practice the present invention.

A shaped segment 74 may be attached to each tooth 66. In the embodiment where the blade 58 comprises a plurality of teeth 66, a shaped segment 74 may be positioned between each pair of teeth 66. Thus, the blade 58 may comprise a plurality of shaped segments 74.

In an embodiment, each shaped segment 74 is a valley 76 between pairs of teeth 66. In a further embodiment, each valley 76 includes a concave shape. Thus, the teeth 66 and valleys 76 can be arranged to provide a waveform shape, preferably sinusoidal. Thus, a repeating pattern across the key 50 may be provided. However, it should be appreciated that the shaped segments 74 may, but need not, be similarly shaped and/or sized to practice the present invention.

In another embodiment, the present invention is directed to an apparatus 78 for attaching the filter bag 20 to the vacuum sweeper 10. The apparatus 78 comprises the sled 80 and the lock 56. Preferably, the apparatus 78 is practiced utilizing the filter bag 20 described above. However, it should be appreciated that other filter bags may be utilized with the apparatus 78.

The sled 80 is configured to receive at least a portion 22, 24 of the filter bag 20. As noted, above, the filter bag 20 is preferably located within the vacuum sweeper cavity 14. Since the sled 80 is configured to receive a portion of the filter bag 20, the sled 80 is also preferably located within the cavity 14. Also, it is contemplated that filter bags will be removed from and received by the sled 80 many times. Therefore, it is preferred that the sled 80 is formed with a durable material such as a hard plastic.

As best shown in FIGS. 3-6, the sled 80 comprises an upper flange 82, a lower flange 84, and a sled body 86.

The upper flange 82 and the lower flange 84 are positioned proximate each other and are attached to a wall 88. In an embodiment, the wall 88 is perpendicular to the flanges 82, 84 and surrounds each flange 82, 84 on three sides. The upper flange 82 and the lower flange 84 are configured to receive the top plate 24 of the filter bag 20. Preferably, the top plate 24 is received between the upper flange 82 and the lower flange 84. The lower flange 84 supports the top plate 24 and, thus, the filter bag 20. Prior to receiving the top plate 24, the upper flange 82 and lower flange 84 are separated by a space or slot 90. The height of the slot 90 is at least equal or, preferably, slightly greater than the thickness of the top plate 24.

Each flange 82, 84 includes a first leg 92, 96 and a second leg 94, 98. In an embodiment, the upper flange first leg 92 is substantially a mirror image of the upper flange second leg 94. However, it may be preferred that the upper flange first leg 92 and the upper flange second leg 94 are differently shaped.

Additionally, the lower flange first leg 96 and second leg 98 may be differently shaped. In an embodiment, the lower flange first leg 96 has an edge portion 100 which is shaped like the blade 58 so that the lower flange first leg 96 can move vertically past an end 99 of the lock 56. Whereas, the lower flange second leg 98 has a substantially planar shape. In this embodiment, the upper flange first leg 92 may have an edge portion which is which is shaped like lower flange first leg edge portion 100.

Apertures 102, 104 are formed in both the upper flange 82 and the lower flange 84. The upper aperture 102 and lower aperture 104 are located between the first legs 92, 96 and the second legs 94, 98 of each flange 82, 84. The apertures may have a generally U-shape and the aperture 104 in the lower flange 84 may be larger than the aperture 102 formed in the upper flange 82. The air outlet 16 may extend through the aperture 102 in the upper flange 82 so that the top plate opening 36 and air outlet 16 can be in communication when the filter bag 20 is installed.

The upper flange 82, the lower flange 84, and the wall 88 are attached to the sled body 86. The sled body 86 provides support to the flanges 82, 84 and the wall 88. In certain embodiments, the sled body 86 may also help to stabilize the movement of the sled 80 within the vacuum sweeper cavity 14.

As seen in FIGS. 3-6, the sled body 86 may comprise a back plate 106 and an arm 108. Preferably, the back plate 106 and the arm 108 are formed in a unitary manner and are in a perpendicular relationship.

A portion of the arm 108 is attached to a side 110 of the back plate 106 nearest the lock 56. Another portion of the arm 108 is attached to the lower flange 84. The arm 108 provides support to the lower flange 84. Specifically, the arm 108 provides support to the first leg 96 of the lower flange 84. In an embodiment, the arm 108 is tapered.

The back plate 106 is also attached to the wall 88 and the lower flange 84 and provides support to both. A slit 112 may be formed in the back plate 106. The slit 112 is located so that it communicates with the slot 90 between the upper and lower flanges 82, 84. In an embodiment, a safety stop (not depicted) is located adjacent the slit 112. In this embodiment, one of the top plate chamfered edges 53, 55 may extend through the slit 112 and contact the safety stop. Preferably, the second chamfered edge 55 is utilized for this purpose. Contact with one or both of the chamfered edges 53, 55 releases the safety stop so that the position of the sled 80 can be adjusted vertically.

The sled 80 may further comprise a spring 114. The spring 114 is attached to an inner portion 116 of the wall 88 and extends horizontally into the slot 90. The spring 114 contacts the spring receiving portion 54 of the top plate 24 to apply a force to the top plate 24. As shown in FIG. 8, the spring 114 contacts the spring receiving portion 54 at or near its center.

In an embodiment, the spring 114 can be of the leaf spring variety. In the embodiment where the spring receiving portion 54 has a concave shape, the arch of the leaf spring is preferably slightly larger than the concave shape of the spring receiving portion 54. However, it should be appreciated that other spring types may be utilized in practicing the present invention. For example, a coil spring could be utilized. Additional elements to ensure good contact between the top plate 24 and the spring 114 may be further included when practicing the present invention. For example, a pivotally mounted guide (not depicted) may be utilized with a coil spring to ensure good contact between the spring receiving portion 54 and the spring 114.

As mentioned, above, the position of the sled 80 is adjustable. Preferably, the sled is adjustable in a vertical direction from a lowered-position to a raised-position and vice versa. In the sled's lowered-position, the sled's flanges 82, 84 and slot 90 are positioned below the end 99 of the lock 56. In the sled's raised-position, the flanges 82, 84 and slot 90 are positioned across from the lock 56.

Referring back to FIGS. 5 and 6, the position of the sled 80 may be adjusted vertically with the use of a rod 118. The rod 118 is fixedly attached to the sled 80. In an embodiment, the rod 118 is configured in an L-shape. In this embodiment, the rod 118 may enter a lower portion 120 of the back plate 106 and extend vertically there through before turning 90° and extending through and beyond the arm 108. The rod 118 also extends beyond a portion 122 of the sweeper housing 12 positioned adjacent the sled 80 through an aperture 124 formed in the housing 12. Although depicted as having an L-shape, it should be appreciated that the rod 118 can assume other shapes and configurations. Further, although shown as positioned within the sled body 86, the rod 118 or substantial portions thereof may be located adjacent the sled body 86.

An end portion 126 of the rod 118 is attached to a lever 128. The lever 128 is connected to the sled 80 via the rod 118. In embodiments where a rod 118 is not utilized in practicing the present invention, the lever 128 may be attached directly to the sled 80.

The lever 128 comprises an arm 130 and a body 132. The arm 130 is integrally formed with the body 132. The arm 130 extends outward from the body 132 and may include a knob 134. The body 132 has a substantially oval shape. A center portion 136 of the body 132 is attached to a pivot point 138 on the housing 12 for rotation thereabout.

The lever 128 can be rotated 90° about the pivot point 138 from a raised-position to a lowered-position and vice versa. To move the lever 128 between these two positions, the lever 128 can be manually adjusted by application of physical force to the arm 130, preferably the knob 134. The force may be provided directly by a vacuum sweeper operator. However, it should be appreciated that the force to rotate the lever 128 could be provided by the operator via an electro-mechanical mechanism.

Figure 5:
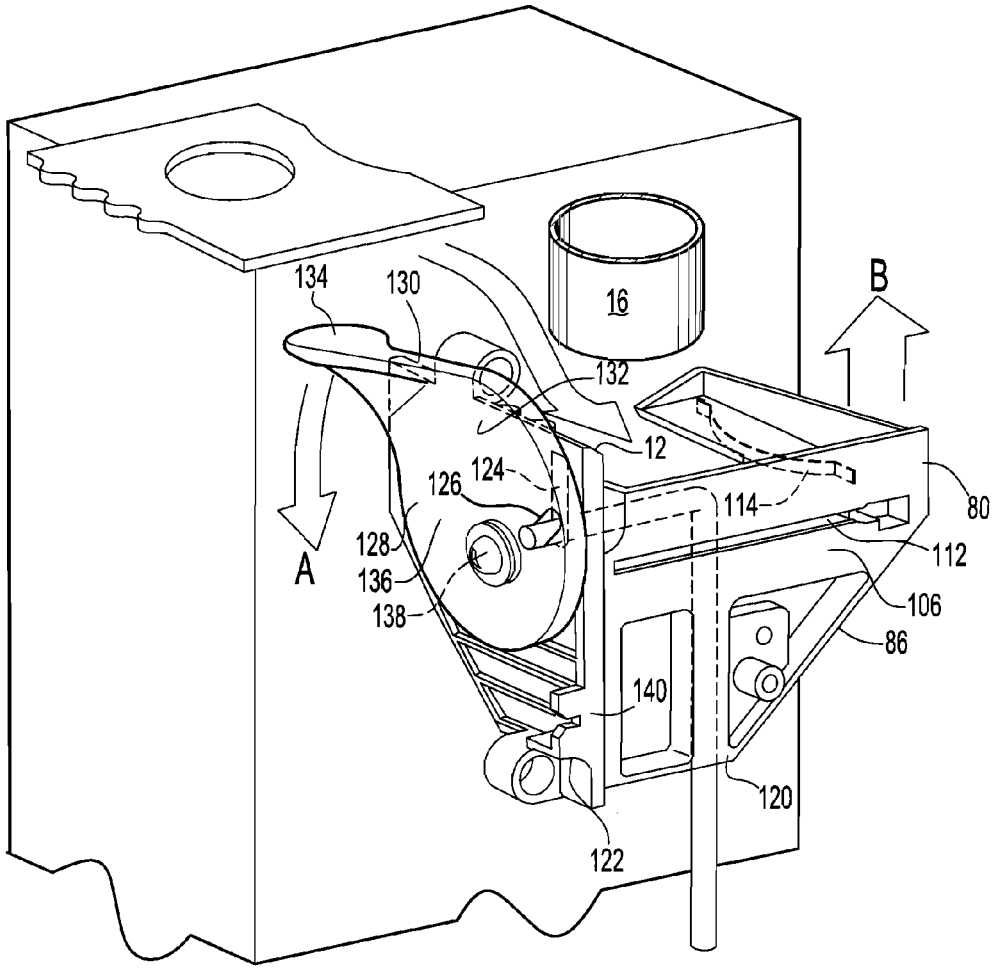
FIG. 5 is a partial perspective rear view of a portion of the vacuum sweeper, an embodiment of the filter bag and the apparatus of the present invention.
Figure 6:
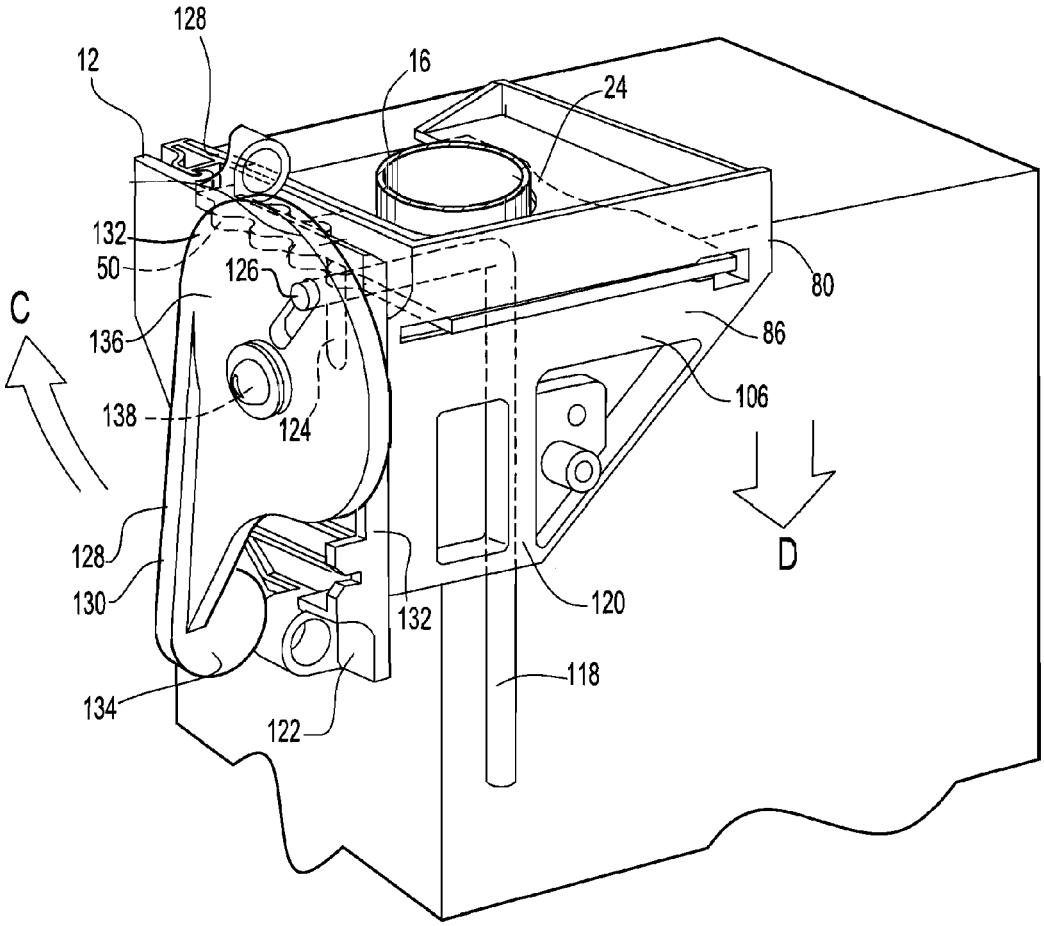
FIG. 6 is a another partial perspective rear view of a portion of the vacuum sweeper, an embodiment of the filter bag and the apparatus of the present invention.

Rotation of the lever 128 moves the rod 118 in a vertical direction. Since the rod 118 is attached to the sled 80, changing the position of the lever 128 also vertically adjusts the position of the sled 80. As shown in FIG. 5 by directional arrows A and B, when downward force is applied to the arm 130, the lever 128 is rotated into its lowered-position and the sled 80 moves vertically into its raised-position. However, as shown in FIG. 6 by directional arrows C and D, upon application of an opposite force to the lever 128, the lever 128 is rotated into its raised-position and the sled 80 moves vertically into its lowered-position.

The lock 56 is attached to the vacuum sweeper 10. In an embodiment, the lock 56 is formed in a unitary manner the vacuum sweeper housing 12. In this embodiment, it is preferable that the portion 122 of the sweeper housing 12 positioned adjacent the sled 80 includes the lock 56 formed thereon. Thus, this portion 122 of the sweeper housing 12 can be formed in a unitary mariner with the main body of the sweeper housing 12. Alternatively, this portion 122 of the sweeper housing 12 can be a separate piece and attached to the main portion of the sweeper housing 12 with screws (not depicted) or another type of fastener through holes 133.

As shown, the lock 56 is attached to a wall 140 on the sweeper housing 12. The wall 140 extends in a vertical direction. The vertical wall 140 may have a substantially planar portion which is positioned in a parallel spaced apart relationship with the arm 108. When the sled 80 is in its lowered-position, the first legs 92, 96 of the upper and lower flanges 82, 84 may contact the planar portion of the vertical wall 140.

The lock 56 and key 50 are configured to selectively interconnect. Selectively interconnect means that the lock 56 and key 50 can be interconnected before operating the vacuum sweeper 10 and disconnected when removing, emptying, and/or replacing the filter bag 20.

In certain embodiments, the lock 56 is formed to have a shape which allows the lock 56 and key 50 to engage each other. In these embodiments, the lock 56 comprises a plurality of teeth 142. As shown, the teeth 66, 142 of the key 50 and the lock 56 may be equal in number. However, it should be appreciated that the teeth 66, 142 need not be equal in number for the key 50 and the lock 56 to be engaged. Further, in order to allow for engagement, the teeth 66, 142 are horizontally offset from each other. In the embodiment where the key 50 has only a single tooth 66, the lock 56 may comprise a single concave valley portion.

Additionally, the teeth 142 on the lock 56 may be substantially the same size and shape as each other and the teeth 66 of the key 50. However, variations between the shape and size of the teeth 66, 142 are acceptable for practicing the present invention. For example, in a preferable embodiment, the teeth 142 extend to the end 99 of the lock 56 in a substantially vertical direction so that their height is greater than that of the teeth 66 of the key 50.

In another embodiment, a first tooth 144 on the lock 56 has a vertical groove 146. In this embodiment, a guide 148 is attached to the upper flange first leg 92 and the wall 88. The guide 148 is interlocked with the groove 146. The interlock between the groove 146 and the guide 148 provides a repeatable course for the sled 80 to follow so that it is located in the same raised- and lowered-position when the lever 128 is rotated. Also, this arrangement ensures that communication between the air outlet 16 and the top plate 24 opening occurs without interference when a filter bag 20 is installed in the vacuum sweeper 10.

A method for installing a filter bag 20 in a vacuum sweeper 10 is also provided.

The method comprises providing the filter bag 20, the sled 80, and the lock 56. As described, above, the filter bag 20 has the top plate 24 and the key 50 formed thereon, the sled 80 is configured to receive the top plate 24, and the lock 56 is adjacent the sled 80.

Also, as noted, above, the position of the sled 80 can be adjusted from its lowered-position to its raised-position and vice versa. It is preferred that for installation of the filter bag 20, the sled 80 is initially in its lowered-position as depicted in FIG. 5. Thus, depending on the position of the sled 80, the method may further comprise applying a force to the arm 130 so that the lever 128 is rotated into its raised-position and the sled 80 is adjusted to its lowered-position.

After ensuring the sled 80 is in its lowered-position, the filter bag top plate 24 is moved in a horizontal direction and slid into the slot 90 between the upper flange 82 and the lower flange 84. As shown in FIG. 7, upon entering the slot 90, a portion of the top plate 24 moves past the spring 114. Then, as shown in FIG. 8, the spring 114 applies a force to the spring receiving portion 54 on the top plate 24. Upon application of the spring force, the top plate 24 is moved in a direction opposite the force until it contacts the vertical wall 140 located on the housing 12.

The sled 80 can then be adjusted in a vertical direction from its lowered-position to its raised-position. As shown by directional arrows A and B, when downward force is applied to the arm 130, the lever 128 is rotated into its lowered-position and the sled 80 moves vertically into its raised-position as shown in FIG. 6.

If an out-of-spec filter bag is inserted into the slot 90 and an attempt to install the filter bag is undertaken, an interference between the filter bag and the end 99 of the lock 56 will occur such that the vertical adjustment of the sled will not be possible. Thus, a filter bag which does not have the top plate 24 and key 50 formed thereon cannot be installed in the vacuum sweeper 10.

Upon adjusting the sled into its raised-position, the key 50 and lock 56 interconnect. When the key 50 and lock 56 are interconnected, communication between the top plate opening 36, the bag portion opening 34, and the air outlet 16 is established. Thus, the filter bag 20 is considered to be installed such that dust and debris material can be collected therein from a surface by the vacuum sweeper 10.

The filter bag 20 can be removed from the vacuum sweeper 10 by reversal of the above-described method. When the filter bag 20 is full, the key 50 and lock 56 can be disconnected upon application of an upward force to the lever 128. Rotation of the lever 128 into its raised-position and vertical movement of the sled 80 into its lowered-position is shown by directional arrows C and D. Thus, the filter bag 20 is selectively attached vacuum sweeper 10.

In accordance with the provisions of the patent statutes, the present invention has been disclosed in what are considered to represent its preferred embodiments. However, it should be noted that the invention can be practiced otherwise than as specifically illustrated and described without departing from its spirit or scope.

We claim:

1. A filter bag for a vacuum sweeper, comprising:

a bag portion for collecting debris material; and a top plate attached to the bag portion, the top plate including a first edge portion having a key which comprises a plurality of teeth and an edge attached to and extending away from a tooth, wherein the edge is parallel to a first edge formed in a second edge portion, and wherein the first edge is attached to a concave spring receiving portion formed in the second edge portion.

2. The filter bag of claim 1, wherein each tooth is substantially the same size and shape.

3. The filter bag of claim 1, wherein the top plate includes four edge portions and a center portion which has an aperture formed therein.

4. The filter bag of claim 1, wherein the teeth engage a lock formed on the vacuum sweeper.

5. The filter bag of claim 1, wherein the top plate and key are unitary.

6. The filter bag of claim 1, wherein the top plate is made from a material which is more rigid than the material used for the bag portion.

7. The filter bag of claim 4, wherein the second edge portion is opposite the first edge portion.

8. An apparatus for attaching a filter bag to a vacuum sweeper, comprising:

a sled comprising an upper flange and a lower flange which are separated by a slot, wherein the slot is configured to receive a top plate of a filter bag having a key formed thereon, and a spring which extends into the slot; and a sweeper housing adjacent the sled, wherein the housing includes a cavity for receiving a portion of the filter bag and a lock that interconnects with the key.

9. The filter bag apparatus of claim 8, wherein the key and lock selectively interconnect.

10. The filter bag apparatus of claim 8, wherein the sled is adjustable.

11. The filter bag apparatus of claim 8, wherein the sled is connected to a lever and wherein the lever can be rotated to adjust the position of the sled.

12. The filter bag apparatus of claim 11, wherein the sled is connected to the lever via a rod.

13. The filter bag apparatus of claim 9, wherein the lock is formed so that it engages the key.

14. The filter bag apparatus of claim 8, wherein the sled further comprises a wall which is attached to the upper flange and to the lower flange.

15. The filter bag apparatus of claim 8, wherein an aperture is formed in both the upper and lower flanges and the aperture formed in the lower flange is larger than the aperture formed in the upper flange.

16. A method for installing a filter bag in a vacuum sweeper, comprising:

providing a filter bag having a top plate, wherein a key is formed in a first edge portion of the top plate;

providing a sled configured to receive the top plate;

providing a lock adjacent the sled;

positioning the top plate within the sled;

applying a spring force to the top plate; and interconnecting the key and the lock so that the filter bag is selectively attached to the vacuum sweeper.

17. The method of claim 16, further comprising adjusting the position of the sled to interconnect the key and the lock.

18. The method of claim 16, wherein the spring force is applied directly to a spring receiving portion formed in the top plate which moves the top plate toward the lock to selectively attach the key and lock.

19. The filter bag of claim 1, wherein the second edge portion further comprises a second edge aligned with the first edge and wherein the concave spring receiving portion is provided between the first edge and second edge.

20. The filter bag of claim 1, wherein the top plate further comprises a fourth edge portion attached to the first edge portion on an end and the second edge portion on an opposite end, wherein an edge of the fourth edge portion is perpendicular to the first edge of the second edge portion.

21. The filter bag of claim 1, wherein the plurality of teeth are formed on an end portion of the first edge portion and extend beyond the edge formed in an opposite end portion of the first edge portion.

22. The filter bag of claim 1, wherein the top plate further comprises a third edge portion having a first chamfered edge, wherein the first chamfered edge is attached to the first edge portion.

23. The filter bag of claim 22, wherein the third edge portion further comprises a second chamfered edge, wherein the second chamfered edge is attached to the second edge portion.

* * * * *

UNITED STATES PATENT AND TRADEMARK OFFICE

CERTIFICATE OF CORRECTION

PATENT NO. : 8,439,997 B2
APPLICATION NO. : 13/210840
DATED : May 14, 2013
INVENTOR(S) : Rupp et al.

It is certified that error appears in the above-identified patent and that said Letters Patent is hereby corrected as shown below:

On the Title Page

Inventors: Replace "Rob Fischner" with --Rob Pfischner--.

Signed and Sealed this
Twelfth Day of November, 2013

Teresa Stanek Rea

Teresa Stanek Rea
*Deputy Director of the United States Patent and Trademark Office*